United States Patent [19]

Trawinski

[11] 4,134,828

[45] Jan. 16, 1979

[54] SYSTEM AND METHOD FOR THE FRACTIONATION OF SUSPENDED SOLIDS BY MEANS OF HYDROCYCLONES

[75] Inventor: Helmut F. Trawinski, Hirschau, Oberpfalz, Fed. Rep. of Germany

[73] Assignee: Amberger Kaolinwerke GmbH, Hirschau,Oberpfalz, Fed. Rep. of Germany

[21] Appl. No.: 798,093

[22] Filed: May 18, 1977

[30] Foreign Application Priority Data

May 21, 1976 [DE] Fed. Rep. of Germany ..... 2622880
Apr. 15, 1977 [DE] Fed. Rep. of Germany ..... 2716611

[51] Int. Cl.[2] ..... B04C 5/14
[52] U.S. Cl. ..... 209/211; 209/496
[58] Field of Search ..... 209/211, 494, 488–491, 209/496; 210/512 R, 532 R, 532 S, 533; 137/4, 92

[56] References Cited

U.S. PATENT DOCUMENTS

| | | | |
|---|---|---|---|
| 2,106,532 | 1/1938 | Lockett et al. | 209/211 |
| 2,629,496 | 2/1953 | Laughlin | 209/496 |
| 2,793,748 | 5/1957 | Herkenhoff | 209/211 X |
| 2,954,871 | 10/1960 | Lummus et al. | 209/211 |
| 3,455,450 | 7/1969 | Hukki | 209/211 X |

*Primary Examiner*—Frank W. Lutter
*Assistant Examiner*—Ralph J. Hill
*Attorney, Agent, or Firm*—Holman & Stern

[57] ABSTRACT

A method and apparatus for fractionation with hydrocyclones for providing the relative sharp separation between separate meshes being divided, by cumulating a slurry-fill as a regulative bulk measured variable below a lower reject nozzle, and adjusting the clearance between the surface of the slurry-fill and the lower edge of an overflow adjusted to a predetermined length which is reversely proportional to a desired separation mesh by means for changing or retaining constant the fill level of the slurry fill.

23 Claims, 20 Drawing Figures

SYSTEM AND METHOD FOR THE FRACTIONATION OF SUSPENDED SOLIDS BY MEANS OF HYDROCYCLONES

FIELD OF THE INVENTION

The instant invention concerns a method for the fractionation of solids of a certain separation mesh in suspensions by means of hydrocyclones, which are provided with an underflow reject nozzle and an upper overflow.

BACKGROUND OF THE INVENTION

The prior art hydrocyclones have, in most cases, a conical shape and are comprising an upper cylindrical and a lower conical portion. They are optimal for obtaining high mass-recoveries, whereby the discharge of solids is made by means of the underflow reject nozzle. In the desired fractionation, one obtains generally small separation meshes. If one desired an increase in the separation mesh, this was possible only by means of an increase of the inflow concentration, i.e., the percentage portion of solids in the feed suspension. This, however, is only possible with an insufficient separation sharpness. In addition, there exists, in general, the disadvantage that the concentration of the feed is continuously changed, especially in the preparation of raw material. This causes the resultant separation mesh of the discharged fractions to fluctuate over an excessively large grain range; such products having an excessively high imperfection quality are not suitable for many purposes of this application.

It should be pointed out here that for the concept of the separation mesh the expressions "cut point" or "separation cut" are common in Germany, for example, the English technical terminology, such as "separation mesh" is used for Trennkorngrösse", or "cut" size is also a commonly used term. In any case, it concerns the over-lapping point of the individual average diameter of the two particle fractions; for simplification only, the term "separation mesh" will be used in the following.

In the prior art hydrocyclones there exists an additional problem in that one is able to fractionate with these only up to a predetermined separation mesh whereby the maximum value depends on the cyclone diameter and the separation mesh barely exceeds 150 μm during the utilization of single-phase-operated cyclones. Separation mesh of 200 μm and more could not be reached in general. The reduction of the pressure of the inflowing suspension again is limited downwardly in order to retain the twist (pitch) which is required for functioning efficiently.

OBJECTS AND SUMMARY OF THE INVENTION

The scope of the instant invention is feasible in that the method for fractionation with hydrocyclones is improved so that with a relatively high separation sharpness, it is possible to obtain a substantially coarser separation mesh than was formerly possible. Furthermore, the scope of the instant invention consists in producing arrangements for performing such a method, whereby the arrangements will be foreseeable in or on hydrocyclones and are manufacturable at a relatively low cost.

In order to solve this problem, the instant invention first proposes to accumulate a slurry-fill as a regulatable measured variable above the underflow reject nozzle, and that the clearance between the surface of the slurry-fill and the lower edge of the overflow be adjusted to a predetermined length which is reversely proportional to the desired separation mesh, by means of changing or retaining constant the fill-level of the slurry-fill. With the instant invention, a dead slurry-fill is determinantly piled up in the lower area of the hydrocyclone as the adjustable measured variable, the upper surface of which representing in the center a horizontal bottom surface of the above-explained clearance. This enables an efficient fractionation also of coarse separation meshes. In addition, the instant invention enables changes to be adjusted in the degree of concentration of the inflowing suspension, without difficulty, in a manner so that they will have no influence on the separation mesh and definition of the discharged fraction.

An increase of the effective clarifying superficies by means of the above-mentioned length of the clearance produces, in the stabilization of the remaining parameters, a reduction of the separation mesh. Under the effective clarifying superficies is thereby understood the surface of the assumed cylinder, which extends over the clearance from the lower edge of the overflow to the level of the slurry-fill, and having approximately the inner diameter of the overflow nozzle, whereby the space, which is filled with the slurry or suspension, is located in and around this cylinder. The clearance may be changed by piling up a corresponding accumulation of slurry, and the desired separation mesh can thereby be obtained. By means of adjusting this clearance and therewith the effective clarifying superficies to a constant value, it will be possible to obtain a very precise stabilization of the resulting separation mesh. Thus, one is able to influence the fractionation of the particles to precisely the predetermined measured variables by means of a regulated change of the fill-level of the accumulation of slurry in the hydrocyclone. Particles having a smaller separation mesh are being removed with the overflow, while particles having a larger separation mesh move through the underflow into in the slurry discharge. It has surprisingly shown that hereby can be obtained, over a comparatively large area of, for example, from 40 to 500 μm of a separation mesh, a very large separation definition, i.e., a low imperfection value. It was especially surprising that just in large separation meshes, i.e., in the coarse grain area, a very high separation sharpness can be obtained. This will substantially increase the suitability of the end-product, and has, in many instances, only now been obtained. It has been further shown that the separation mesh flows constantly with the increase or the amount of slurry, whereby the separation mesh is approximately reversely-proportional to the distance from the clearance between the slurry level and the lower edge of the overflow nozzle.

The instant invention produces in a technically-controllable manner, the possibility of utilizing the height of the accumulated slurry amount, as the measured variable for the stabilization control of the separation mesh, whereby a corresponding increase or decrease of the overall cross section of the reject nozzle, or of a suitable outlet valve may serve as the standard size. It is possible, by means of this preferred embodiment of the instant invention, to obtain a decrease or an increase of the off-take discharge on solids, whereby again a corresponding lowering or rising of the slurry level results in the hydrocyclone. The adjustment to be made here in the opening cross section of the reject nozzle is also control-technically as well as constructively accomplished in a simple and effective manner.

Under certain operational conditions, for example, during the consequent preparation of intermediate products, the amount of inflow and concentration of the suspension in certain limits is constant. In such cases, there suffices the above-explained adjustment of the height of the slurry-fill. However, if the inflow quantity, and/or the concentration of the suspension supplied to the hydrocyclone changes to a great extent, as, for example, is the case in the preparation of raw material, it can then happen under unfavorable operational conditions that either the slurry level accumulates to an excessive height and thereby clogs the hydrocyclone, or that there will not be a sufficient accumulation of a certain amount of slurry-fill in the hydrocyclone. In both aforementioned cases, the desired adjustment could no longer be carried through. In order to also solve this problem, a further, preferred embodiment of the instant invention proposes that the slurry exiting from the reject nozzle, be measured by means of weighing a liquid level outside the hydrocyclone and its viscosity, and at an increasing and/or decreasing viscosity the opening cross section of the reject nozzle is enlarged and/or reduced in a manner so that the viscosity is maintained constant to an approximately adjustable value. The concentration of the slurry exiting from the eject nozzle is thereby maintained to an approximately constant value, and it is neither too much nor insufficient, or even in borderline instances, slurry accumulates in the hydrocyclone. The measuring of the viscosity may be made either in the main flow or in a secondary flow (by-pass) which is separated from the main flow of the slurry exiting from the reject nozzle.

The instant invention further proposes a coordination of the two above-explained control loops. This, for once, is the control loop which controls the opening crosscut of the eject nozzle for obtaining a desired height or mass of the accumulated slurry. For the other, this is the latter-described control loop which, dependent on the viscosity of the exiting slurry, influences the cross sectional change of the eject nozzle. Both control loops can be brought together into a mutual differential-adjustment, which in coordinating the measuring results of both control loops, will effect the adjustment of the opening cross section of the eject nozzle.

The instant invention furthermore concerns an arrangement for performing the above-disclosed method. Thus, according to one proposal of the instant invention, there is provided either one or a multitude of preferably-annular damming areas suitable for forming a slurry-fill (accumulation) of a required height. If there are also more than one area of damming, then, for reasons of simplicity, only one area of damming will be mentioned; on the damming area forms the undersurface of the slurry-fill. It is therefore recommended to provide the damming area in the lower portion of the chamber between the reeject nozzle and the lower edge of the overflow cylinder. This will enable varying forms of the hydrocyclone. The substantial criteria for the hydrocyclone and the damming area consists in that a slurry-fill acccumulates during operation, and that there exists the possibility of a variation of the escape of solids through the eject nozzle.

The discharge which flows into the discharge nozzle is located below or immediately at the underside of the damming area, and may, for example, be of a conical shape. Such a damming area in itself can easily be produced as an annular disc extending from the casing of the cyclone inwardly; the diameter of this annular disc may vary according to the respective operational conditions.

The instant invention concerns itself further with control and adjusting devices as component parts for the performance of the above-mentioned method. The instant invention further concerns a viscosity container to be arranged below the eject nozzle, for the purpose of collecting either wholly or partially the slurry which is being discharged from the eject nozzle, and discharging said slurry through an outlet having a reduced opening in contrast to its cross section. Thus, a regulating device is proposed for the purpose of retaining constant the viscosity of the slurry exiting from the eject nozzle, whereby said regulating device either enlarges or decreases the cross sectional opening of the eject nozzle of the hydrocyclone dependent on the increase or decrease of the slurry amount located in the viscosity measuring-container above the outlet of the same. Also such a viscosity-measuring container and its regulating devices can be manufactured with relatively simple means and thereby at a low cost.

According to a further, preferred embodiment of the instant invention, there is proposed a limiter for the purpose of adjusting the clearance below the lower edge of the overflow and serving to determine the separation mesh, which limiter is located within the hydrocyclone, and limiting upwardly the stationary slurry-fill forming below it, whereby the limiter is constructed as a floating member having a specific weight which is greater than the expected pulp or fluid density above the slurry-fill, and smaller than the specific weight of the stationary slurry-fill; and means are provided for determining the respective elevation of the limiter floating in the hydrocyclone, which means, in connection with regulating members, compare this elevation with a preset face value and effect an adjustment of the cross sectional opening of the eject nozzle. This limiter may move in the hydrocyclone somewhat like a piston in a cylinder. The space volume below the limiter is filled with the slurry and forms a stationary slurry-bed. An effort should thereby be made so that sufficient radial space is available between the limiter and the hydrocyclone wall for the passing of the particles, separated above the limiter, into the area below the limiter. The clearance above the limiter defines the clearance responsible for the separation mesh, namely, representing the vortex-finder clearance length. This clearance and therewith the determination of the separation mesh of the fractionation process is more distinctly determined by means of the limiter than by means of the surface area of the stationary slurry-fill. This limiter in a simple manner is a portion of a control loop which enlarges or reduces the cross sectional opening of the reject nozzle of the hydrocyclone and therwith effecting a sinking or lowering of the slurry fill and with it the limiter, so that a predetermined previously adjusted height of the limiter within the hydrocyclone is retained.

Additional objects, advantages and characteristics of the instant invention will become apparent from the following description of preferred embodiments of the invention taken with the drawings, forming a part thereof, and in which the schematic drawings show:

DESCRIPTION OF PREFERRED EMBODIMENTS

Figure 1:
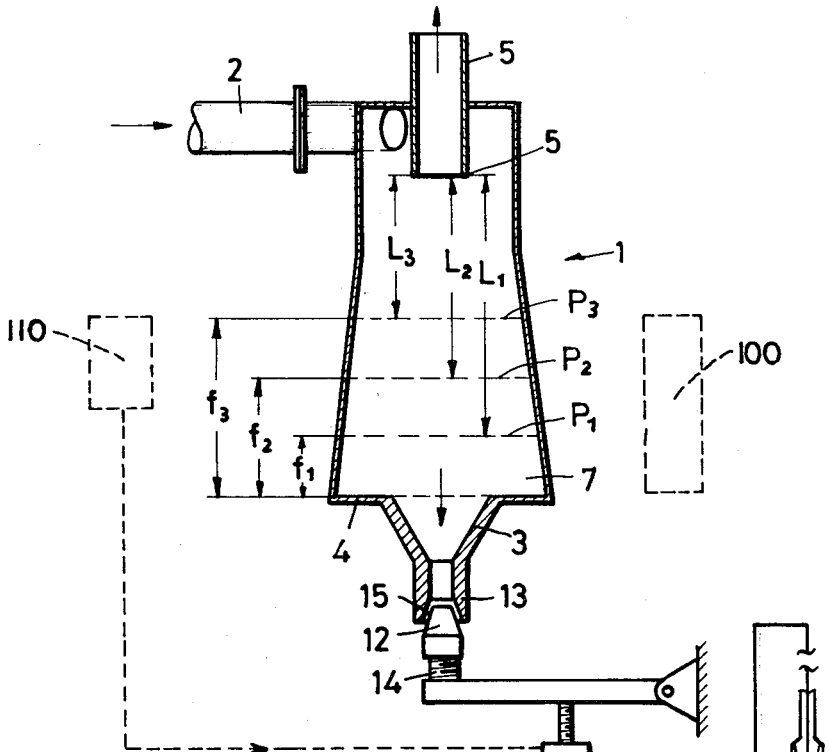
FIG. 1 is a diagramatic, elevational view in partial cross section of one embodiment of the invention.

In FIG. 1, a hydrocyclone is indicated generally at 1. A suspension or slurry is tangentially supplied under pressure through a flexible tube 2 so that it circulates inside the cyclone in a convoluted decending path or threaded-passage according to the cyclone principle (not explained in detail). At 3 is the outlet for the solids, and 4 indicates a damming ring area to be explained in detail, while at 5 is an overflow for the fluid from which is separated the solids from the hydrocyclone which are wholly or partially, the finer of the two separated fractions.

With the supplying of a corresponding amount of suspension of a certain solids content, the annular damming area 4 will function to form above it a slurry accumulation 7. This is indicated in FIG. 1 by the fill-heights or levels $f_1$, $f_2$, and $f_3$ of various heights of slurry accumulations. This results in various lengths of clearances $L_1$, $L_2$ nand $L_3$ between the surfaces or levels $p_1$, $p_2$ and $p_3$ of the slurry accumulation and the lower edge 5' of the overflow 5. As explained above, the separation mesh of the discharged solids is reversely-proportional to the distance or clearance L, or, it increases constantly with the fill level f.

Figure 2:
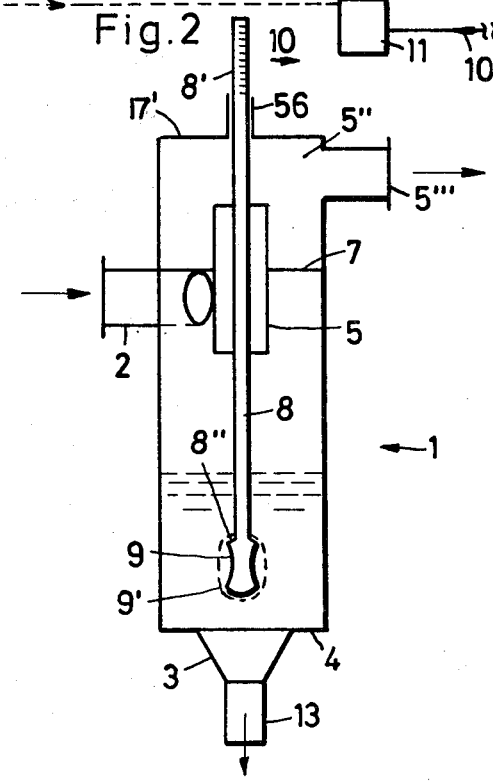
FIG. 2 diagramatically illustrates a hydrocyclone with a hydraulically-operated probe for determining the slurry level.

The respective position of level P of the slurry-fill 7 can be determined by means of a hydraulically-functioning probe 8 which is explained in greater detail in the embodiment of FIG. 2. There is provided at its lower end of the probe 8 a membrane 9, which, depending on the hydrostatic pressure inside the cyclone, is compressed a greater or lesser degree, whereby the slurry-level in the hydrocyclone is indicated at a calibrated display gage 8'. The display pipe 8' may be located within a guide sleeve 56 of an overflow chamber 5'' which is located on coverplate 17 of the hydrocyclone 1, and supplying the overflow through a short feed pipe 5'''. The pressure membrane 9 and a probe-measuring head 8'' are surrounded by a protective cage 9'. In general, the hydrocyclone may be constructed in any suitable manner.

The measured results of the hydrostatic measuring probe accoding to FIG. 2 may be translated into electrical value at 10 which is supplied, according to FIG. 1, to a servo motor 11 which alters the position of a throttle mandrel 12 associated with an eject nozzle 13. When the hydrocyclone is empty, a basic position of throttle mandrel 12 can be adjusted in relation to the eject nozzle 13, i.e., to obtain a predetermined opening cross section 15, by means of a threaded member 14 upon which throttle 12 is mounted. Thus, by means of this threaded member 14 there can be obtained a justification of the throttle mandrel 12 with regard to its height position, whereby the desired separation mesh, which is to be separated from the hydrocyclone, can be adjusted.

The probe 8 and the servo motor 11 are so designed that an increase of the slurry-fill and therewith an enlargement of the filling height f via the servo motor results in a downward movement of the throttle mandrel 12, whereby the opening cross section 15 of the eject nozzle 13 is accordingly enlarged; thus, there exits more solids from the nozzle 13 per unit time, whereby the slurry-fill lowers, i.e., the fill height f is reduced. This adjustment process starts on the fill-height f which corresponds with the separation mesh which is set by means of the screw 14.

The throttle mandrel 12 does not require much maintenance and is safe to operate. To protect it against wear, it may be provided with a cap consisting of either a hard metal, of rubber, or of a synthetic elastic (elastomer) material. Instead, electrical, hydraulic, or pneumatic valve means would be feasible as nozzle throttle means in the sense of adjusting members. Further, in place of the hydraulic probe 8, there may also be provided other measuring devices. Thus, as in FIGS. 15 and 16, there is disclosed a measuring device which is oriented on the mass of the slurry-fill. It would also be possible to determine the fill level f by means of X-rays or isotopic rays issuing for example from a radiating source 100, shown dotted in FIG. 1, the rays being received by a relay box 110, the output of which is used to control the servo motor 11. All measured values, as explained in the embodiment of FIG. 1, could affect also an electrical, hydraulic, or pneumatic control for changing the opening cross section 15 of the eject nozzle 13.

FIG. 1 shows a hydrocyclone casing, having a diameter which increases in cross section downwardly; at its bottom is located the annular damming area 4, which extends at its inner margin into the outlet cone 3, and at the end of which is located the eject nozzle 13.

FIGS. 3 to 7 illustrate additional form-structures of the cyclone casings in connection with an annular damming area (each indicated at 4), whereby all remaining structural elements of the instant invention are not illustrated. At this point, it should be mentioned that the other cyclone members may differ substantially from its inner form structure. For example, in the prior art are outwardly cylindrical, or the diameter-graduated cyclone members have an inner form structure which, in a traditional manner, is of a conical shape.

Figure 3:
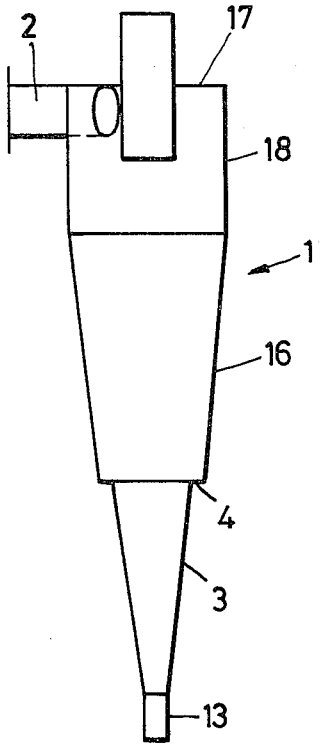
FIGS. 3 to 7 diagramatically show embodiments of different hydrocyclones.

In the embodiment of FIG. 3, the hydrocyclone casing 16 is slightly conical downwardly, whereby in this embodiment the width (diameter) of the annular damming area 4 is smaller than in the embodiment of FIG. 1. The conical angle of portion 16 does not necessarily have to be in conformity with the conical angle of outlet 3, which may be very flat or shallow.

In these embodiments, 17 indicates an upper coverplate of hydrocyclone 1 which is penetrated by the overflow 5, the upper edge of the outlet-cone 3 always abuts the inside marginal edge of the annular damming area 4.

Figure 4:
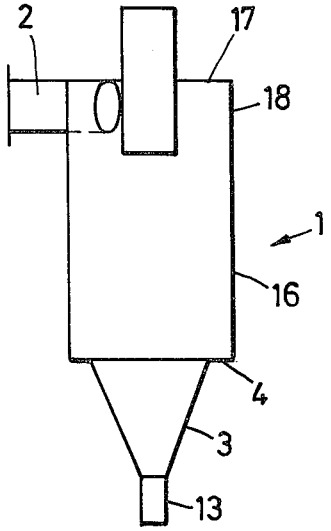

FIG. 4 shows a hydrocyclone 1 having a cylindrical casing or upper portion 16, which lengthens the cylindrical feed-portion 18. The width (diameter) of the annular damming area 4 in this embodiment is somewhat larger than in the embodiment of FIG. 3. The diameter of the outlet cone 3 is reduced in comparison with the diameter of the cylindrical portion 16. The inner diameter of the annular damming member is preferably 0.4–0.1-times the diameter of the cyclone casing 16 at the connection of the annular damming area 4.

Figure 7:
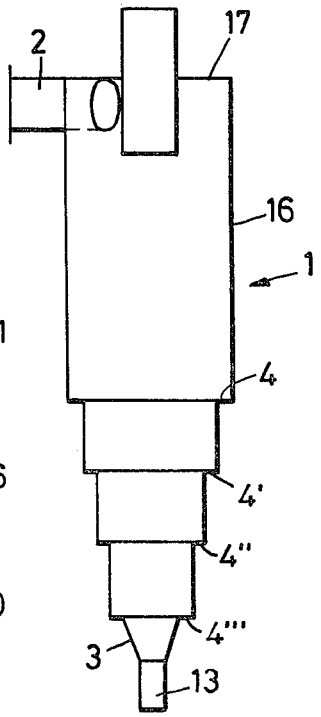
Figure 5:
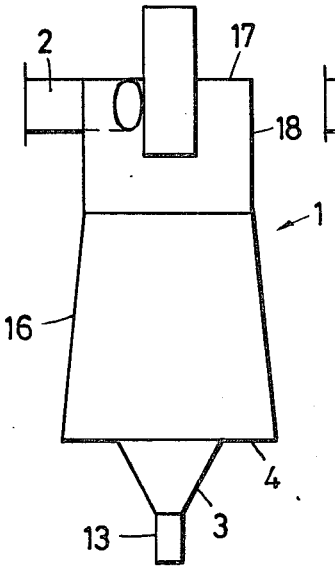
Figure 6:
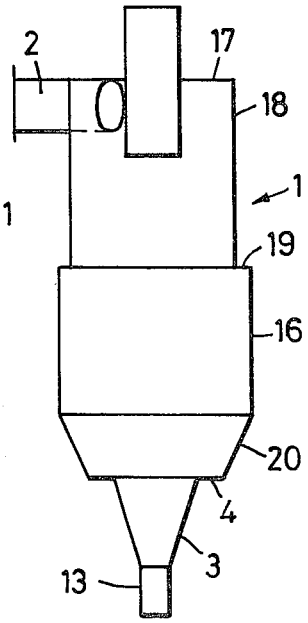

FIG. 5 illustrates a hydrocyclone casing 16, having a diameter which is similar to FIG. 1, i.e., it increases downwardly towards the annular damming area 4; this produces an enlarged maximum diameter of the cyclone and therewith an increased diameter and area of the annular damming member 4. The embodiment of FIG. 6 shows a lengthened cylindrical feed portion 18 which increases at 19 to the diameter of the cylindrical casing portion 16, adjacent to which — but not necessarily so — comprises a conical portion 20 which diverges or decreases downwardly, and which continues into the annular damming area 4. In FIG. 7 is a terraced arrangement of a multitude of annular damming areas 4 to 4''', whereby the diameter of the individual annular areas decrease from the top toward the bottom; the casing 16 in this embodiment is of cylindrical shape.

The various embodiments of FIGS. 3 to 7 illustrate that the invention can be utilized with different forms of cyclones.

Figure 8:
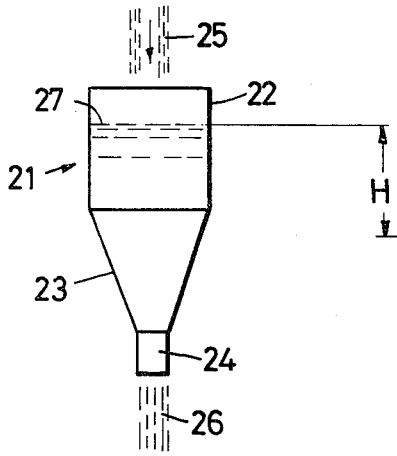
FIGS. 8 and 9 diagramatically represent viscosity-measuring containers.
Figure 9:
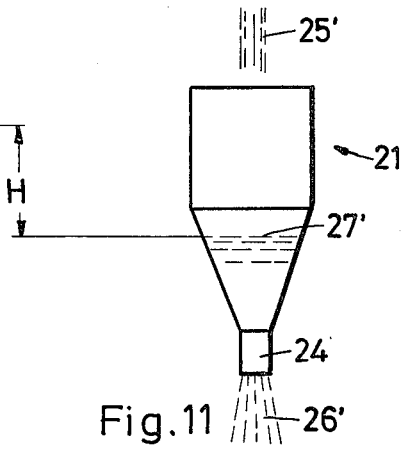
Figure 10:
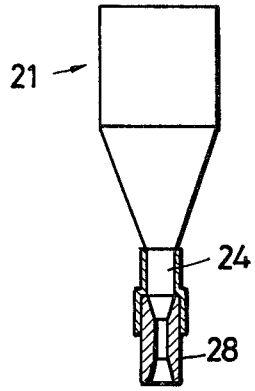
FIGS. 10 to 14 diagramatically show embodiments of viscosity-measuring containers and cooperating regulating devices.
Figure 11:
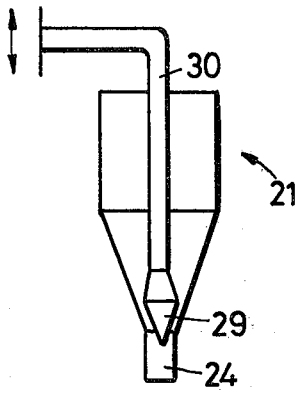

In FIGS. 8 to 14 are illustrated viscosity-measuring containers representing preferred embodiments of the instant invention in the principle, illustrating various designs and applications. In FIG. 8, the viscosity-measuring container 21 is of a pot-shaped design and includes an upper cylindrical portion 22, connected to a downwardly-diverging conical portion 23, connected to an outlet 24. A slurry 25 is discharged from the ejection nozzle of a hydrocyclone (not illustrated in detail), flowing continuously through the viscosity-measuring container 21 and exiting at 24 in the discharge 26. The container 21 may receive the entire discharge slurry of the hydrocyclone (main flow) or by only a proportional portion of the slurry from a by-pass, for example. In case the solids-content in the slurry 25 is relatively high, this results in a corresponding increase of the slurry density, as well as in an increased effective viscosity of the dual-phase mixture, resulting first in a reduction of the discharge speed of the slurry flow 26 from the outlet 24 and secondly, accompanuing a rising of the slurry-level 27 in the container 21 until the rate of discharge or discharge-speed, required for continuous flow, is reached. According to FIG. 8, during a thick feed-in 25 and a firstly lower discharge speed of the slurry-flow 26, there results a relatively high slurry level 27, in FIG. 9 it is assumed that the feed-in 25' is only a thin concentration; from this results a low viscosity of the slurry flow 26' and therewith a lower slurry level 27'. The height-difference H represents a measurable variable utilized for controlled regulation. The increased volume in the case of FIG. 8, produces in connection with the slurry density a simultaneous increase in contrast to the operational condition according to FIG. 9, and a substantially-increased full-height of the container 21. The difference H may be utilized by weighing for the controlled stabilization of the concentration of the slurry flow 25 which is discharged from the hydrocyclone. It is therefore recommended to provide for an exchangeable outlet nozzle 28 at opening 24 for the coarse or area-adaptation, as seen in FIG. 10. In place of nozzle 28, there is also proposed, according to FIG. 11, an axially-displaceable throttle-mandrel (valve) 29, which is also automatically adjustable possibly by means of a rod 30. The viscosity-measuring container 21 is adjustable to the required regulating area, which substantially results from the total capacity of the hydrocyclone and the expected consistency of the slurry 25. The two above-noted factors determine the slurry-discharge amount per time unit. It is also understood that the volume of the measuring container 21 must be adjusted to the slurry discharge amount of the cyclone expected per time unit.

Figure 12:
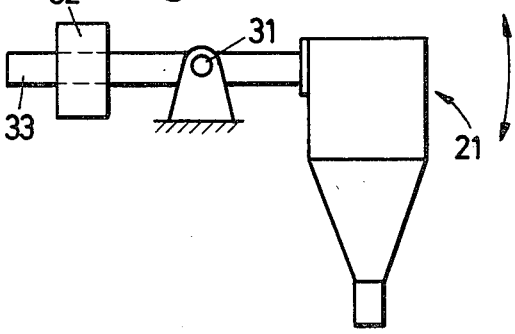
Figure 13:
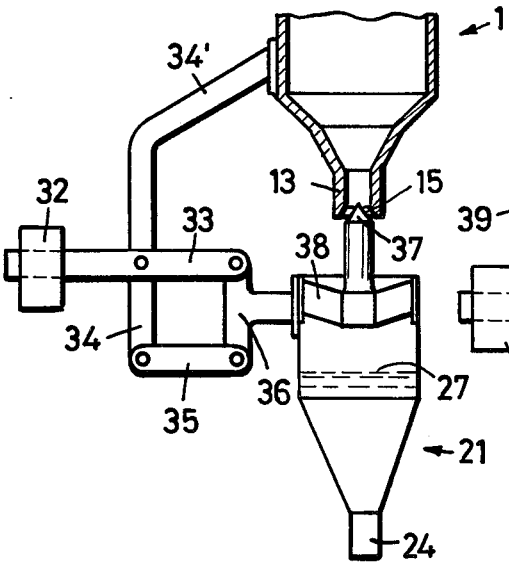

FIG. 12 illustrates the principle of a tiltablepositioning of pivot 31 of the viscosity-measuring container 21 for displacing the height due to weight changes. A zero-position can be calibrated by means of a counter weight 32, which is adjustable on a scale balance beam 33 Instead of a single pivot 31 there can be parallel linkage comprising guiding link elements 34, 35 and 36, as seen in FIG. 13; the viscosity-measuring container 21 attains a vertical movement during lowering or lifting due to weight changes. FIG. 13 further shows how this arrangement may be utilized to stabilize for a solid content of the outflow of the hydrocyclone by utilizing the slurry-viscosity as the measured variable of a control cycle. A mandrel 37 is mounted to the upper end of the measuring container 21 and penetrates wholly or partically into the ejection nozzle 13 of the hydrocyclone 1. If the solids content of the slurry 25, which is discharged from the cyclone at 13, is too high, then, according to numeral 27 the slurry-level attained at (see explanation of FIG. 8), the slurry level in the viscosity-measuring container 21 rises. This increases, as mentioned above, the weight in container 21, and container 21 moves downwardly; since mandrel 37 moves out of the underflow nozzle 13, the opening cross section 15 on the nozzle 13 becomes greater and therewith a thinning of the slurry which exits at 15. This thinning of the slurry, in turn, effects a lowering of the slurry-level 27 in container 21; if the viscosity of the container 21 is insufficient and the slurry-level 27 is thereby too low, then this results in a corresponding reduction of the weight of container 21 and therewith, due to counter weight 32, in an upward-movement of the container, accordingly, there results a reduction of the cross sectional gap 15 by the mandrel 37. The above-mentioned functional adjustment stabilizes itself resulting in a predetermined value in the concentration of solids in the slurry discharge from the cross section 15 of nozzle 13; this value can be set by means of the weight 32, on lever 33 of the parallel linkage. In order to guarantee a smooth operation of the regulation device it is possible to provide a device for damping (not shown), a spring or the like, for the pivotal movements of the scale balance beam 33, or links 33–36.

Figure 13A:
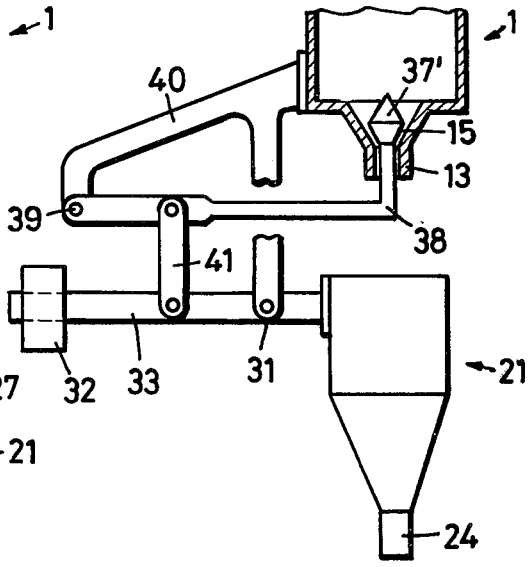
Figure 14:
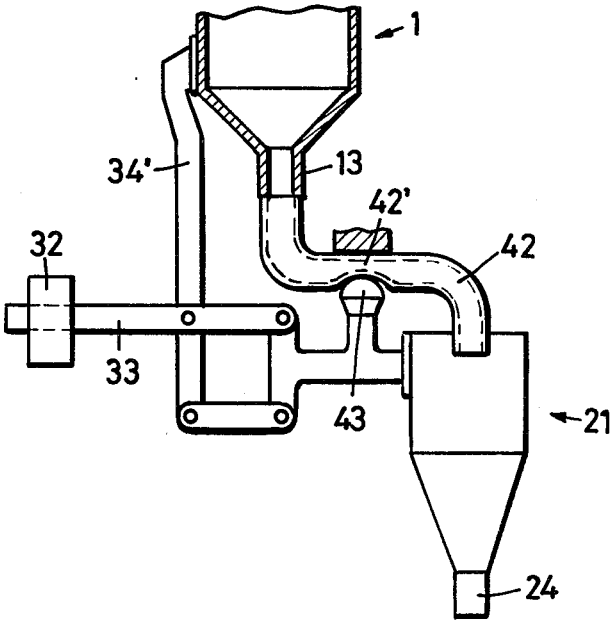

In the embodiment of FIG. 13, the mandrel 37 is fixedly connected on the container 21 by means of a console or spider 38. The above-mentioned parallel-suspension linkage 33–36 is fixedly mounted on the casing of the hydrocyclone 1 via an extension 34' integral with guide member 34. This arrangement could also be effected in accordance with FIG. 13*a*, where the mandrel or valve element 37' is located inside the cyclone 1 and the eject nozzle 13 of the same could be closed from above, i.e., from inside the cyclone. The mandrel 37' is mounted on a lever 38' which is pivotably mounted at 39 on support arm 40 which is fixedly mounted on the cyclone 1. The pivotable movement of the measuring container 21, i.e., caused by weight changes, is transmitted to the lever 38 via guide link 41 connected between balance beam 33 and lever 38; also, in this embodiment, there is caused the opening or enlarging of the opening cross section 15 by a too thick flow of the slurry discharged from nozzle 13. FIG. 14 illustrates a system similar to the arrangement of FIG. 13; the major difference is that in FIG. 14 the reduction of the opening cross section of discharge nozzle 13 is effected by pressing an elastic slurry-discharge tube 42 by means of a stem 42 toward or away from an abutment 42' which stem in this case assumes the function of the mandrel 37 or a similar valve element; in this example, the concentration of the slurry discharging from the cyclone is retained constant.

In place of the mandrels 37, 37';, or the stem 43, it is possible to utilize the change of the weight of the viscosity-measuring container 21 to effect other, similarly functioning controls for achieving the corresponding change of the opening cross section 15 of the discharge nozzle 13.

Figure 15:
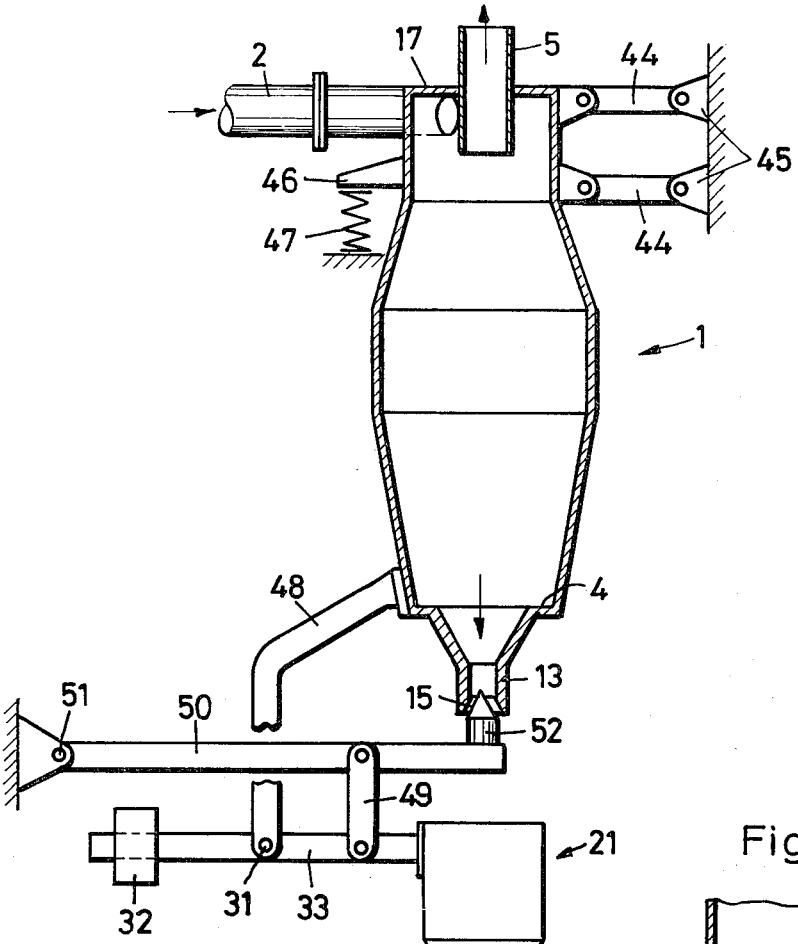
FIGS. 15 and 16 respectively, diagramatically show two embodiments illustrating cooperation between a hydrocyclone and a viscosity-measuring container according to the instant invention.

FIG. 15 shows a hydrocyclone 1 having a casing which is different in appearance from the one shown in FIGS. 1 to 7; in which it is also provided with an annular damming area 4 and a discharge nozzle 13. The hydrocyclone 1 is suspended on a stationary support means 45 by means of two parallel guide members 44, so that it moves substantially vertically during upward and downward displacements. Weight of the hydrocyclone 1 stresses a spring member 47 via an arm 46; this is an expedient to accommodate for the mass of the slurry-fill located therein, and thereby for the fill-levels f (see FIG. 1). It should be noted that instead of the spring member 47 there can be utilized a pressure-measuring device for generating an electrical charge, the value of the same affecting an electrical regulating device; for example, a servo motor which activates as explained below, differential rods for lifting and lowering a mandrel or control element 52.

Counter to the effect of the spring member 47, there takes place a lowering or lifting of the hydrocyclone 1 under respective increasing or decreasing of the slurry-level. This vertical movement of the hydrocyclone 1 is transmitted to a differential system by means of a rod 48; the differential system comprising in this embodiment a lever system; at the pivot 31 there is again suspended the scale balance beam 33 with the adjustable counterweight 32 and the viscosity-measuring container 21. The rod or bar 48 is hinged to the scale balance beam 33 at 31; upward and downward movements of the hydrocyclones are transmitted to a lever 50 by means of a link rod 49; the lever 50 being fixedly hinged at one end at 51, and carrying at its other end the mandrel or control element 52, which herein combines with it the functions illustrated in FIG. 1 and FIG. 13. On the basis of the translatory effects of lever 50, there results a vertical movement of the hydrocyclone 1, via the lever portions 48, 44, 49 and 50, and a greater vertical movement of mandrel 52 in contrast to movement of cyclone. An excessively high slurry-fill in the hydrocyclone 1 effects its lowering and thereby an enlarging of the opening cross section 15 via the mandrel 52 at the eject nozzle 13, until, due to the thereby resulting load-reduction in the hydrocyclone and the basic position of the throttle mandrel, the desired fill-level in the hydrocyclone is balanced.

When there exists an excessively high slurry-concentration, there also results a lowering of the viscosity-measuring container 21 which cause a widening of the opening cross-section of nozzle 13 via parts 33, 49, 50 and 52, and a thinner slurry discharge results.

It will also be seen that the sinking as well as the lifting upwards of the hydrocyclone, according to its slurry-level and the reaction of the spring means 47, as well as the sinking and lifting of the viscosity-measuring container 21 according to the setting of the weight 32, and the concentration of the slurry outflow via the differential rod system 48, 33, 49 and 50, influences the position of the mandrel 52 in the reject nozzle 13, and therewith the size of the opening cross section, which, finally, will be balanced to a desired value; the control loops each of which being illustrated in FIGS. 1 and 13 (or 13*a* and 14) operate together.

The regulation of the concentration of the slurry-outflow from the hydrocyclone may also be obtained with other common methods and devices. This may, for example, be an electrical, a hydraulic, or a pneumatic throttle valve whereby a density measuring of the pulp (slurry) density of the discharged slurry may serve as the feed of this control loop, which can be accomplished, for example, by means of X-rays or radioisotopes or by means pycnometric on-line measurements.

Figure 16:
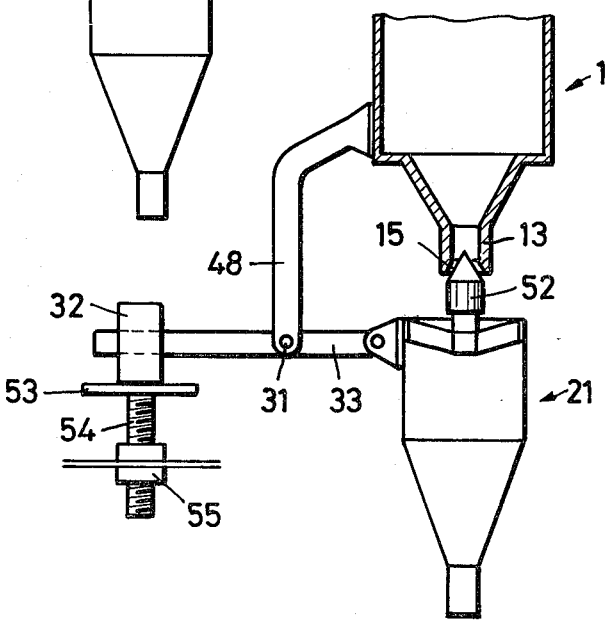

FIG. 16 shows an arrangement which, in the general principle, is similar to that shown in FIG. 15, however, this is a simpler construction. Also, in this case, two control systems cooperate and function differentially. The scale balance beam 33 has the function of a single lever 50 in FIG. 15. A support arm 48 engages in a pivot point 31 of the scale balance beam 33. A load change in the hydrocyclone 1 results in a vertical movement or the cyclone against the effect of a corresponding adjusting spring; such as that shown at 47 in FIG. 15, whereby this movement is translated into a corresponding downward vertical movement of the throttle mandrel 52. At this point of the stationary pivot point 51, according to FIG. 15, there is proposed an abuting means on an abutment plate 53 which limits the downward movement of the weight 32, which plate 53 in itself is fixedly mounted but which is adjustable in the height. The mandrel 52 is in this manner moved out of the nozzle 13 during the sinking of the hydrocyclone 1. For an empirically correct fixing of the zero point — in the reciprocating play with the function of the viscosity scale — an adjustable spindle rod 54 permits vertical displacement of the abutment plate 53, relative to weight 32.

The rod 54 may be fixed, for example, by means of a nut or a counternut 55; the viscosity regulation, by means of the measuring container 21, is superimposed to the above-mentioned load-regulation by means of the cyclone 1 in the same manner as in the embodiment of FIG. 15.

FIG. 17, again, shows a hydrocyclone 1 with a eject nozzle 13, overflow 5, feed 2 and damming area 4 according to the various previously-discussed embodiments. A clearance L extends, in the instant and in the following embodiments from the lower edge 5' of the overflow 5 upward to the central upper surface of a limiter 57 below which is located the stationary slurry fill. In this, and in the following embodiments, there is provided a limiter 57 in the form of a floating member, having a specific gravity which is higher than that of the suspension density which is to be expected above the slurry bed, and lower than the specific gravity of the stationary slurry bed 7 which comprises that slurry density. This floating limiter 57 has a first function outlined above, namely, of a more distinct limiting of the clearance L. It is possible to measure the slurry level by means of this limiter in a very simple, namely, direct mechanical manner, for example by means of a cord 62 which is rolled up onto a measuring roller under the effect of a spring, and indicating there the respective slurry level, or indicating the clearance L at another gage. The cord 62, or a measuring rod, not shown in this example, is in this construction and especially simple embodiment guided upwards through the overflow 5. The measuring of the height position of the limiter 57 could principally also be made in another manner, for example magnetically, by means of ray-measurement (isotopes) and the like.

The elevation of this body can clearly be determined measure-technically by means of the floating limiter 57, and thereby the size of the clearance L may be utilized for its adjustment to a pre-determined value. The actual value of the elevation of the limiter 57, or the clearance L which is shown on the scale of the measuring roller 63, is measured, and this actual value is compared by means of a separate, for example, electrical regulating arrangement 64, having a desired value which is set in accordance with the desired separation mesh, and is supplied by the same regulating arrangement 64, shown in FIG. 17, only principally, to a device for changing the opening cross section of the eject nozzle 13. As such, a device may serve, for example, the illustrated mandrel 59. The regulating device is of such a structure that, during a large clearance L, the mandrel 59 reduces the cross section of nozzle 13, whereby accordingly more slurry accumulates and the limiter 57 rises; a distance L which is too small, results, however, in an enlargement of the opening cross section of nozzle 13 via the mandrel 59. The regulating device thereby balances the elevational position of the limiter 57 to the desired value. Additionally, by means of the flow-through viscosity meter 21, previously described in the above-mentioned embodiments, the flussy discharged from the eject nozzle 13 can be measured by weighing its damming level in its viscosity, and during increasing and/or reducing viscosity the opening cross section of nozzle 13 can be enlarged and/or reduced by means of the mandrel 59, so that the viscosity is retained constant substantially at an adjustable value. Numeral 61 depicts a counter-weight for the pot-shaped viscosimeter 21. A differential rod system according to FIG. 16 may thereby be utilized, so that the control values of the arrangement 63, 64 combines with those of the viscosity pot 21.

Figure 18:
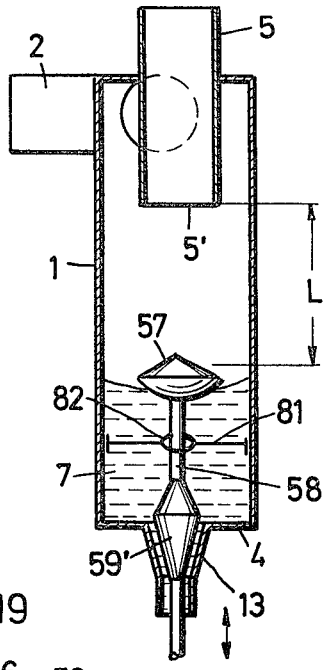

The embodiment of FIG. 18 shows a floating limiter 57 onto which is fastened a downwardly-directed rod 58, guided at 82 in support 81 carrying a mandrel 59'. The mandrel 59' is located inside the hydrocyclone 1, (similar to the mandrel 29 of FIG. 11) and ajusts therefore the opening cross section of the nozzle 13 from the inside. In general, the adjustment is hereby made immediately. In order to be able to justify the fill level, the height position of the cone-shaped mandrel 59' on the rod 58 is adjustable, for example by means of constructing rod 58 as a threaded spindle and the mandrel 59' as a threaded nut, adapted thereto.

Figure 17:
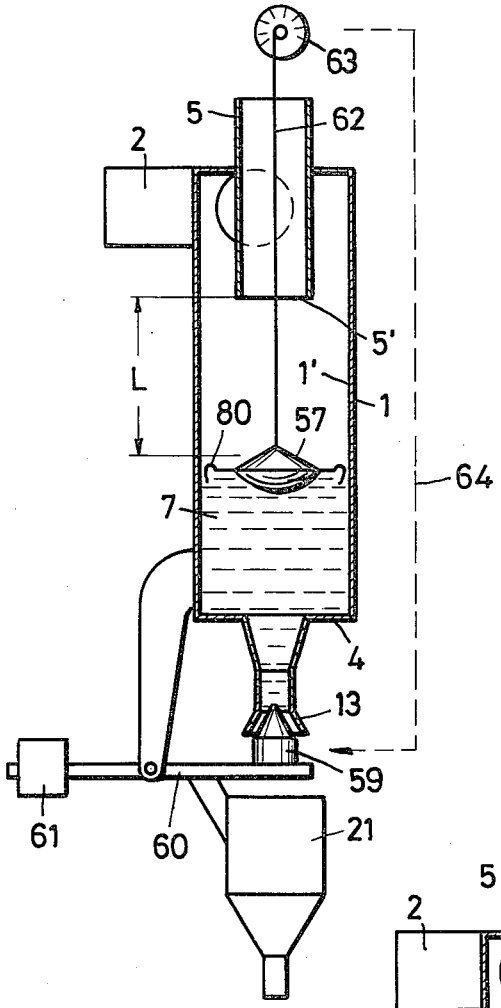
FIGS. 17 to 19 diagramatically, respectively illustrate different embodiments of means for adjusting the height of a limiter utilizing a floating element.
Figure 19:
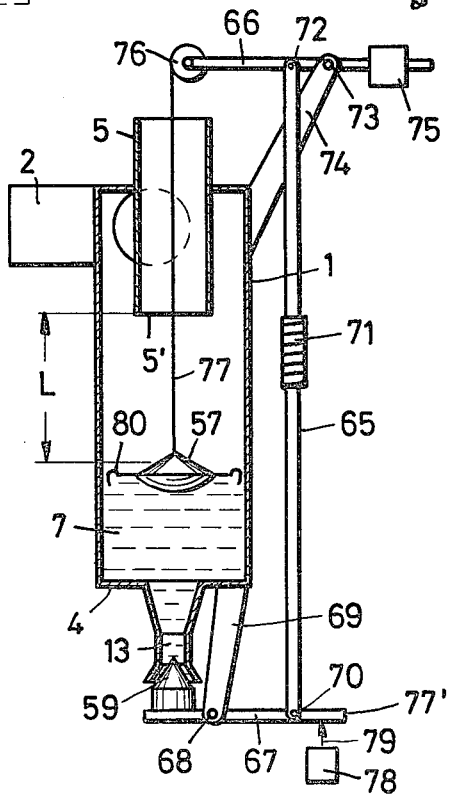

In contrast to the separate control arrangement of the embodiment of FIG. 17, there is provided an immediate adjustment according to the embodiment of FIG. 19 in a sense of the principle of immediate adjustment according to the embodiment of FIG. 18 by means of inherent impulses, namely, a mechanical, and in itself closed, control loop. It is therefore proposed, according to FIG. 19, to provide a control rod system outside the hydrocyclone 1 which comprises a connecting rod 65 and an upper lever 66, as well as a lower lever 67. The lower lever 67, carrying the mandrel 59, is hinged at 68 on a fixed arm 69 on the hydrocyclone and is pivotably connected at 70 with the lower end portion of connecting rod 65; the length of rod 65 may be adjusted for precise justification of the position of the mandrel 59 by means of a turnbuckle 71. The upper end of the connecting rod 65 is hinged at 72 on the lever 66, which at 73 is hinged to a further upper arm 74 on the hydrocyclone, and carrying a counter-weight 75, as well as a roller means 76 at its other end, onto which is wound a cord 77 which holds the floating member 57. The desired length of the cord 77, and therewith the desired length L of the above-mentioned clearance, may be adjusted on the roller 76. Hereby is adjusted the standard elevation of the limiter, and the separation mesh is adjusted via the free length clearance L. The weight 75 functions so that the cord 77 is constantly tensioned. The lever 66 is stressed by the weight of the limiter 57 as well as by its own weight and the weight of potions 67, 71, so that in case of the slurry bed running empty, the mandrel 59 completely seals the reject nozzle 13; the counter weight 75 should be positioned in a manner so that it will not interfere with the closing of the nozzle during aforementioned operating conditions. If the hydrocyclone is again placed in operation, the slurry bed then fills up until it lifts the limiter 57 and adjusts it to the desired standard elevation. Analytical consideration should hereby be given to the load of the slurry head above the nozzle cross section, since this will prevent the hydrocyclone from running empty, a special safety measure against the possibility of the cyclone running empty, such as, for example, in the form of the above-explained flow-through viscosimeter 21, is in this case not required.

In place of the cord 77 and its roller means 76 there could also be proposed a rod which could be adjustably hinged on the respective end portion of lever 66. In this case, one would not require the counter weight 75.

In contrast to the embodiment of FIG. 18, there results the advantage with the embodiment according to FIG. 19 that the throttle mandrel 59 is located exteriorally of the hydrocyclone and that a possible danger of the nozzle getting clogged is prevented. Further, in the embodiment according to FIG. 19, the gage adjustment is taken from the slurry bed by means of the roller 76 and the rod system. whereby a possible danger of blockage is prevented.

In the embodiment according to FIG. 19, it becomes further possible to effect a remote adjustment of the desired value of the clearance L by means of a small electric hollow-up motor (not illustrated) for the roller 76. The emptying of the slurry bed, which is required when switching off the pump motor, may be accomplished by means of an electric servo motor 78, which lifts the end portion 77' of the lever according to arrow 79.

For the purpose of centering the floating limiter 57 there could be provided on the same, for example, three radially-outwardly-extending arms 80 which slide along the inner surface of the cylindrical hydrocyclone. The slurry which is deposited about the limiter can pass between the arms 80 downwardly for the purpose of forming the slurry bed 7. During the stopping of the limiter 57 by means of a rod 58 (FIG. 18), such centerings are not absolutely necessary, but if desired, they could also be provided. In accordance with the embodiment of FIG. 18, arms 81 could serve for this purpose, being mounted on the inside wall of the hydrocyclone, wherein said arms surround the rod 58 with a guide means 82, whereby between rod 58 and guide means 82 there is proposed a certain amount of guide-play.

What I claim is:

1. The method of fractionally separating a liquid suspension into a heavier fraction and a lighter fraction comprising introducing a flow of said suspension into a hydrocyclone separator having an upper overflow and a lower adjustable reject nozzle to effect separation of said suspension into heavier and lighter fractions, discharging said lighter fraction through said upper overflow and said heavier fraction through said reject nozzle, controlling the rate of discharge of said heavier fraction through said nozzle relative to the rate of introduction of said suspension into the separator to provide a slurry fill within said separator above said reject nozzle, measuring the level of said slurry fill above said reject nozzle and controlling the height of said slurry fill to establish the separation mesh of said fractions.

2. The method according to claim 1, characterized in that the rate of discharge of said heavier fraction is controlled by adjusting the cross section of said reject nozzle in relation to the height or mass of the slurry fill.

3. The method as claimed in claim 2 including the step of measuring the viscosity of said heavier fraction discharged from the reject nozzle, and controlling the cross-sectional opening of the reject nozzle in relation to the measured viscosity so that the viscosity is maintained at a substantially constant value.

4. The method as claimed in claim 3 in which a control loop for changing the cross section opening of the reject nozzle according to the fill level or mass of the slurry level, and a second control loop for changing the opening cross section of the reject nozzle in relation to the viscosity or concentration of the heavier fraction being measured are combined into a mutually differential regulation which influences the adjusting of the opening cross section of the reject nozzle.

5. A system for fractionally separating a liquid suspension into a heavier fraction and a lighter fraction said system comprising a hydrocyclone separator for receiving and separating the suspension, said separator including an upper overflow for discharging the lighter fraction, a lower adjustable reject nozzle for discharging the heavier fraction and means defining at least one annular damming area above said reject nozzle, said reject nozzle including control means for controlling the cross-sectional opening of the reject nozzle for adjusting the rate of discharge of said fraction to establish a slurry fill above said damming area and means for controlling the height of said slurry fill thereby controlling the separation mesh of said fraction.

6. The system as claimed in claim 1 in which said hydrocyclone separator includes a plurality of annular damming areas spaced between said lower reject nozzle and said upper overflow, said damming areas having respective progressively increasing areas toward said reject nozzle.

7. The system as claimed in claim 1 including measuring means for measuring the height or mass of the slurry fill, and means for transmitting the measured results to said control means for adjusting the reject nozzle cross section whereby the slurry level can be adjusted.

8. The system as claimed in claim 7, including means for adjusting the opening cross section of said reject nozzle of the hydrocyclone separator when the hydrocyclone separator is empty for establishing a predetermined base value prior to operation of the separating system.

9. The system as claimed in claim 8 including spring means operatively engaged with said hydrocyclone separator and against which the weight of said hydrocyclone separator reacts, the spring force, subject to the weight of said hydrocyclone, being operatively connected to a device for setting the opening cross section of the reject nozzle.

10. The system as claimed in claim 1 in which said means for controlling the height of the fill level of slurry includes a hydraulically-responsive probe for reflecting the hydraulic force in relation to the depth of the slurry.

11. The system as set forth in claim 7 in which said measuring means includes means to assertain the level of the slurry in said hydrocyclone and comprises any one of X-ray or isotopic ray means.

12. The system as claimed in claim 7 in which said measuring means includes means for measuring the weight of the slurry and comprises a pressure-measuring container.

13. The system as claimed in claim 7 in which the measuring means comprises means for measuring the slurry fill level and includes at least one of an electrical, hydraulic or pneumatic control means operatively connected to the control means for changing the opening cross section of the reject nozzle.

14. The system as claimed in claim 7 in which the control means in series with said reject nozzle for changing the cross-sectional opening thereof comprises a control element adjustably-controlled for movement into or out of said reject nozzle.

15. The system as claimed in claim 5 wherein said means for controlling the height of said slurry fill includes below said reject nozzle a viscosity-measuring container for receiving a proportional part of the heavier fraction discharged from the reject nozzle, said viscosity-measuring container and a regulating device for controlling the viscosity of said heavier fraction in response to changes in the quantity of said heavier fraction in said viscosity-measuring container.

16. The system as claimed in claim 15 in which said regulating device comprises a rod system operatively connected to an adjustable weight and balance beam whereby the weight of the viscosity-measuring container can be correspondingly adjusted in relation to the opening cross-section of the hydrocyclone separation due to weight changes of the viscosity-measuring container.

17. The system as claimed in claim 15 including a differential linkage system operatively connected to said hydrocyclone separator for reflecting changes between the weights of said hydrocyclone and viscosity-measuring container in relation to said adjustable weight, the differential linkage system including means for adjusting the opening cross-section of the reject nozzle in accordance with the total result of changes of the weight of the hydrocyclone and viscosity-measuring container.

18. The system as claimed in claim 5 including a limiter within the hydrocyclone separator for limiting the upper level of the slurry fill in said hydrocyclone, the limiter comprising a float element, having a specific gravity which is greater than the expected slime density at said overflow, and which is less than the specific weight of the slurry in said hydrocyclone;

means for identifying the elevation of the limiter and adjusting means connected to said identifying means for comparing the elevation of said limiter with a preset desired value, and effecting adjustment of the opening cross section of the reject nozzle in relation to said limiter.

19. The system as claimed in claim 18, wherein said limiter includes a measuring means guided through said overflow for transmitting the elevation of said limiter to a rod system externally of said hydrocyclone; and means for adjusting the cross section of said reject nozzle in relation to movement of the limiter on said rod system.

20. The system as claimed in claim 19, wherein said rod system includes an intermediately pivoted lever, a roller at one end supporting the measuring means extending through said overflow, a weight and an adjustable rod hinged on said lever for tensioning the measuring means, and a further lever carrying a control element operatively associated with said reject nozzle.

21. The system as claimed in claim 18, including means for automatically preventing undesired emptying of the hydrocyclone.

22. The system as claimed in claim 18, wherein the limiter is supported and centered within the hydrocyclone by means of arm elements permitting slurry to penetrate therethrough.

23. The system as claimed in claim 22, including a rod connected to an element for controlling the cross-section of said reject nozzle, said arms including guide means surrounding the rod.

* * * * *